US007207440B2

(12) United States Patent
Briscoe

(10) Patent No.: US 7,207,440 B2
(45) Date of Patent: Apr. 24, 2007

(54) BLISTER PACK

(75) Inventor: Gary Malcolm Briscoe, Wilmslow (GB)

(73) Assignee: Mr. Blister Limited, Manchester (GB)

( * ) Notice: Subject to any disclaimer, the term of this patent is extended or adjusted under 35 U.S.C. 154(b) by 0 days.

(21) Appl. No.: 10/764,280

(22) Filed: Jan. 23, 2004

(65) Prior Publication Data

US 2004/0149616 A1 Aug. 5, 2004

Related U.S. Application Data

(63) Continuation of application No. PCT/GB02/03408, filed on Jul. 24, 2002.

(30) Foreign Application Priority Data

Jul. 27, 2001 (GB) ..... 0118329.2

(51) Int. Cl.
*B65D 73/00* (2006.01)
*B65D 39/00* (2006.01)

(52) U.S. Cl. ..... 206/461; 206/470; 220/780; 220/790

(58) Field of Classification Search ..... 206/461, 206/464, 467, 470, 471, 806; 220/780, 789, 220/790, 4.22, 4.23
See application file for complete search history.

(56) References Cited

U.S. PATENT DOCUMENTS 4,742,935 A * 5/1988 Schellenberg ..... 220/791
5,209,354 A 5/1993 Thornhill et al.
5,220,999 A * 6/1993 Goulette ..... 206/470
5,383,568 A 1/1995 Tusick et al.
5,507,406 A * 4/1996 Urciuoli et al. ..... 220/789
5,803,248 A * 9/1998 Cox ..... 206/467
6,311,838 B1 * 11/2001 Johnson et al. ..... 206/438
6,474,471 B1 * 11/2002 Miyake ..... 206/471

FOREIGN PATENT DOCUMENTS

DE 1923177 11/1970
EP 0857661 8/1998

* cited by examiner

*Primary Examiner*—Mickey Yu
*Assistant Examiner*—J. Gregory Pickett
(74) *Attorney, Agent, or Firm*—Gauthier & Connors, LLP

(57) ABSTRACT

A blister pack of a translucent plastics material and having a recessed front part for receiving and containing an article to be packaged, and a back part having a relieved portion for insertion into a recessed portion of the front part for closure of the pack. The front part has a plinth with an inwardly projecting ridge, and back part forms a plinth having an outwardly projecting lip which becomes inter-engaged with the ridge to lie wholly within the plinth of the first part thus to be largely inaccessible and thus prevent premature opening of the pack. The front part has a surrounding flange with a formation which gives the appearance of a weld thus to deter attempts to open the pack prematurely.

9 Claims, 2 Drawing Sheets

BLISTER PACK

This is a continuation International Application PCT/GB02/03408 filed on Jul. 24, 2002 and which designated the U.S.

THIS INVENTION concerns blister packs which are packaging items produced usually in transparent or translucent plastics materials and vacuum formed from a single sheet of such material to provide a front part usually recessed for receiving and containing an article to be packaged and displayed, and a back part to act as a closure. The two parts are usually connected together by a hinge portion which is integral with the front and back parts and which allows the parts to be closed after insertion of the article to be packaged.

Blister packs fall into two main types one of which is produced such that after packaging of the article, the front and back parts are thermally welded together so that to open the package it is necessary to cut within the weld line to enable the parts to be separated. This type of pack is generally used when it is not intended for the article to be removed from the pack until after purchase, but it is more expensive in production and packaging and is sometimes considered to be inconvenient in that the contents must be inserted during production of the pack, and cannot be inspected properly without destroying the pack.

The other type of blister pack is one where the front and back parts are opened and closed by way of a friction or snap fit usually provided by means of co-operating detent means between the front and back parts. This type is much less expensive to produce and has the advantage that the contents may be inserted and removed (and reinserted) without destroying the pack.

Most blister packs include, on at least one of the parts, an outer flange which at one end of the pack has an aperture for suspending the pack along with other similar packs on a display hook. In the case of the non-welded type of pack the front and back parts generally have such flanges which lie in superimposed relationship when the pack is closed and enable insertion of a finger or tool between the flanges to enable opening the pack.

Many users of such packs prefer a welded pack to prevent tampering with or premature removal of the packaged articles, but the additional cost of such packaging often outweighs the advantages of increased security.

It is an object of the present invention to provide a blister pack which possesses the cost advantage of a non-welded pack but which is more difficult to open than the conventional non-welded pack, and yet affords the appearance of a welded pack thus rendering it less obviously capable of being opened prior to purchase of the contained article or articles.

According to the present invention, there is provided a blister pack comprising a front part having a recessed portion for receiving and containing an article to be packaged, a back part having a relieved portion adapted for insertion into the recessed portion of the front part for closure of the pack, and co-operating locating means on the front and back parts respectively to maintain the pack in a closed condition; characterised in that the locating means comprises an abutment on the inner wall surface of the recessed portion of the front part, and a co-operating abutment on the outer wall surface of the relieved portion of back part, the inner and outer wall abutments being located thereon such that they become inter-engaged to close the pack only when the back part is contained wholly within the recessed portion of the front part.

The front part may have a flange extending around the rim of the recessed portion.

The flange may include an aperture for suspension of the blister pack upon a display hook.

The flange may include a peripheral formation to provide the appearance of a weld.

The abutment of the front part may comprise a continuous ridge protruding inwardly from the wall surface of the recessed portion.

The abutment of the back part may comprise a continuous narrow flange protruding outwardly from the relieved portion.

The front and back parts of the pack may be connected together with an integral hinge portion, the entire pack being formed by deformation of a single sheet of translucent plastics material.

The front part on its inner or outer surface may have a surface texture to render the front part translucent with reduced transparency.

An embodiment of the invention will now be described, by way of example only, with reference to the accompanying drawings, in which.

Figure 1:
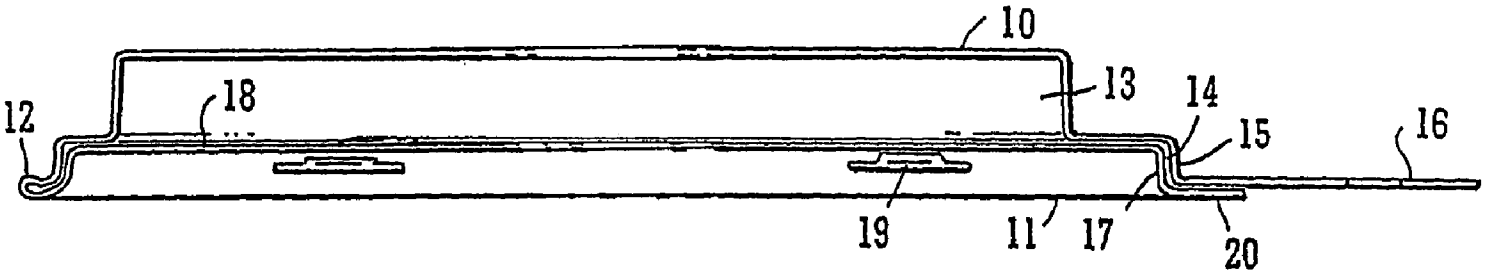
FIG. 1 PRIOR ART
FIG. 1 is a vertical cross-sectional view of a conventional blister pack of the kind with which this invention is concerned.

Referring to FIG. 1, a conventional blister pack comprises front and back parts 10 and 11 respectively vacuum formed from a single sheet of plastics material, usually transparent or at least translucent and connected together by an integral hinge portion 12.

The front part 10 is recesses at 13 to receive an article to be packaged and has a stepped recess 14 forming a plinth 15 around the recessed portion 13, and a peripheral flange 16 which usually will contain an aperture (not shown) for suspending the pack on a display hook or the like.

The back part 11 also has a shallow recessed portion 17 forming an inner plinth 18 which fits closely within the outer plinth 15 of the recessed front part when the pack is closed. One or more detent means 19 co-operating between the front and back parts 10 and 11 are provided to maintain the pack in a closed condition allowing it to be opened and closed with a snap action.

The back part 11 also has a flange 20 which lies in superimposed relationship with the flange 16 when the pack is closed and provides access between the two flanges for opening the pack.

Figure 2:
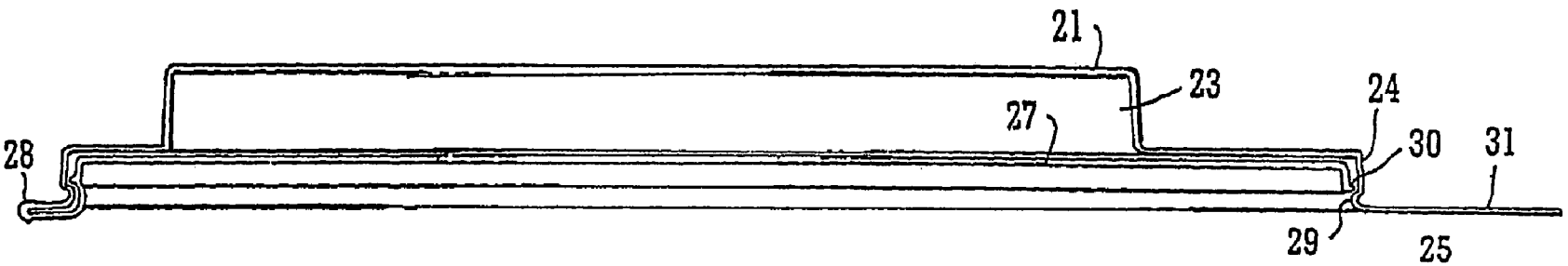
FIG. 2 is a similar view of a blister pack made in accordance with the invention.

Referring now to FIG. 2, a blister pack made in accordance with the invention again consists of front and back parts 21 and 22 respectively, the front part again having a recessed portion 23 for containment of the article to be packaged. As in the case of the conventional pack the front part has a stepped recess forming a plinth 24 and an outer flange 25 extending peripherally around the plinth 24. An aperture 26 (FIG. 3) known as a EUROSLOT is provided at one end of the pack to enable its suspension on a display hook.

The back part 22 has a relieved plinth 27, and an integral hinged portion 28 connects the front and back parts 21 and 22 together.

In this case, and in accordance with the invention, the plinth 24 on the front part 21 includes an inwardly projecting abutment in the form of a ridge 29 which extends around the rearmost part of the recess within the plinth 24, and forms one part of a locating means for closure of the pack.

Also as can be seen from FIG. 2, the relieved plinth 27 of the back part 22 has at its outermost extremity a narrow flange or lip 30 which when the pack is closed forms a snap-action with the ridge 29 of the front part and is contained forward of the latter so that the back part 22 is contained wholly within the front part 21. It is thus extremely difficult to open the pack without considerable distortion of the front part to enable the rim 30 to be forced outwardly past the ridge 29. In other words, no part of the back part 22 of the pack is accessible exteriorly of the pack as opposed to the accessible flange 20 of the back part 11 of the conventional pack illustrated in FIG. 1.

Thus, the pack made in accordance with the invention is easy to close but difficult to open, and this is achieved without welding of the two parts together, so that the pack may be filled by an end user rather than by the pack manufacturer.

Figure 3:
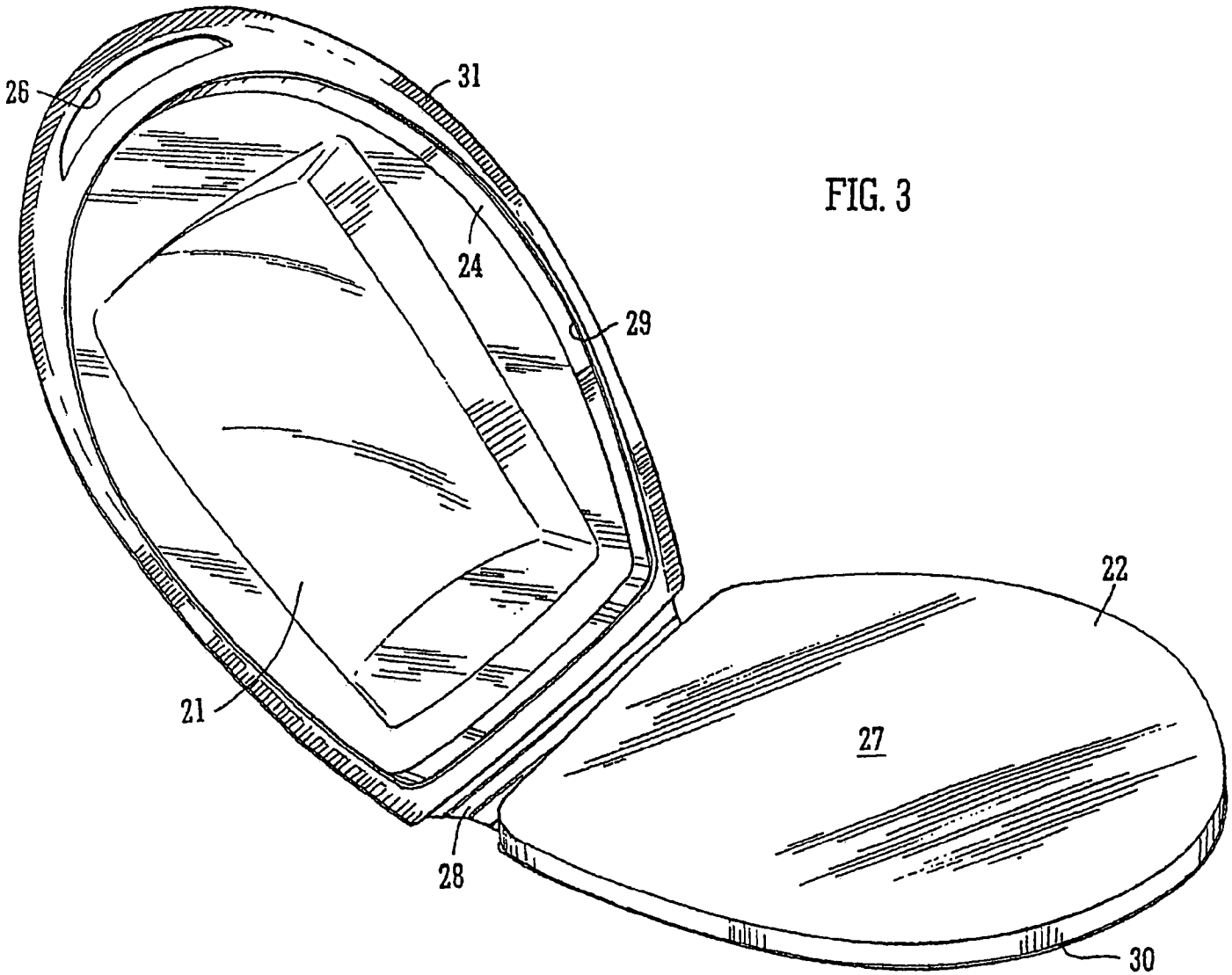
FIG. 3 is a perspective view of the pack of FIG. 2 in an open condition.

Referring now to FIG. 3 where such a pack is shown in an open condition, it will be seen that around the perimeter of the flange 25 of the front part 21 there is a "mock weld" in the form of a formation or projecting ridge 31 thus to give the appearance of a welded pack which serves to deter attempts to open such a pack before purchase.

If required, the front part 21 may, in its formation, be given an outer and/or inner surface texture thus to reduce its transparency and provide a "matt" finish.

Typically, a pack made in accordance with the invention will have a plinth 24 of some 8 mm in depth with the ridge 29 extending some 2 mm into the plinth, and the plinth 27 of the back part may be some 6 mm in depth with the lip 30 extending outwardly therefrom by approximately 1 mm all around its perimeter. The hinged portion 28 is of sufficient flexibility to enable the back part 22 to be fully inserted into the front part 21 to produce a secure pack in which the method of closure is difficult to detect.

The parts 21 and 22 of the pack may be reversed in role so that the part 22 becomes the front of the pack for display of the packaged article or articles.

The invention claimed is:

1. A blister pack for receiving and containing an article to be packaged comprising a front part having a recessed portion, a back part having a recessed portion adapted for insertion into the recessed portion of the front part for closure of the pack, and cooperating locating means on the front and back parts respectively to maintain the pack in a closed condition; wherein the locating means comprises of an abutment on the inner wall surface of the recessed portion of the front part, and a cooperating abutment on the outer wall surface of the recessed portion of the back part, the inner and outer wall abutments being located thereon such that they become inter-engaged to close the pack; wherein at least a substantial majority of the back part is wholly contained in the recessed portion of the front part; the abutment on the inner wall surface of the recessed portion of the front part extending inwards from said wall surface to at least as great an extent as that by which the abutment of the recessed portion of the back part comprising a continuous narrow flange protruding outwardly from the recessed portion and forming an outmost edge of the back part within the recessed portion of the front part when the back is closed such that none of the back part extends outwardly of the abutment of the recessed portion of the front part of the pack when the pack is closed.

2. A blister pack according to claim 1, wherein the front part has a flange extending around the rim of the recessed portion.

3. A blister pack according to claim 2, wherein the flange includes an aperture for suspension of the blister pack upon a display hook.

4. A blister pack according to claim 2, wherein the flange includes a deformation of material in a peripheral region to provide the appearance of a weld when the abutments are inter-engaged.

5. A blister pack according to claim 1, wherein the abutment of the front part comprises a continuous ridge protruding inwardly from the wall surface of the recessed portion.

6. A blister pack according to claim 1, wherein the front and back parts of the pack are connected together by an integral hinged portion, the entire pack being formed by deformation of a single sheet of translucent plastics material.

7. A blister pack according claim 1, wherein the front part, on its inner or outer surface, has a surface texture to render the front part translucent with reduced transparency.

8. A blister pack according to claim 1, wherein the front part has a stepped recess forming a plinth with an outer flange extending peripherally around the plinth.

9. A blister pack according to claim 1, wherein the respective abutments of the front and back parts become inter-engaged with a snap action when the pack is closed.

* * * * *

UNITED STATES PATENT AND TRADEMARK OFFICE

CERTIFICATE OF CORRECTION

PATENT NO. : 7,207,440 B2
APPLICATION NO. : 10/764280
DATED : April 24, 2007
INVENTOR(S) : Gary Malcolm Briscoe It is certified that error appears in the above-identified patent and that said Letters Patent is hereby corrected as shown below:

In claim 1: should read

A blister pack for receiving and containing an article to be packaged comprising a front part having a recessed portion, a back part having a relieved portion adapted for insertion into the recessed portion of the front part for closure of the pack, and cooperating locating means on the front and back parts respectively to maintain the pack in a closed condition; wherein the locating means comprises of an abutment on the inner wall surface of the recessed portion of the front part, and a cooperating abutment on the outer wall surface of the relieved portion of the back part, the inner and outer wall abutments being located thereon such that they become inter-engaged to close the pack, wherein at least a substantial majority of the back part is wholly contained in the recessed portion of the front part; the abutment on the inner wall surface of the recessed portion of the front part extending inwards from said wall surface to at least as great an extent as that by which the abutment of the relieved portion of the back part <u>extends outward from the outer wall surface thereof, the abutment of the back part</u> comprising a continuous narrow flange protruding outwardly from the relieved portion and forming an outmost edge of the back part within the recessed portion of the front part when the back is closed such that none of the back part extends outwardly of the abutment of the recessed portion of the front part of the pack when the pack is closed.

Signed and Sealed this

Twenty-fourth Day of July, 2007

JON W. DUDAS
*Director of the United States Patent and Trademark Office*